United States Patent [19]

Kummerow et al.

[11] Patent Number: 4,468,977

[45] Date of Patent: Sep. 4, 1984

[54] POWER DRIVE FOR ELECTRIC SWITCHGEAR IN WHICH DRIVING POWER IS ELASTICALLY TRANSMITTED THERETO

[75] Inventors: Gerd Kummerow; Werner Troebel; Bernhard Preuss; Reinhard Zeuke, all of Berlin, Fed. Rep. of Germany

[73] Assignee: Siemens Aktiengesellschaft, Berlin and Munich, Fed. Rep. of Germany

[21] Appl. No.: 253,587

[22] Filed: Apr. 13, 1981

[30] Foreign Application Priority Data

Apr. 15, 1980 [DE] Fed. Rep. of Germany ..... 3014825

[51] Int. Cl.[3] ..... H01H 3/22; H01H 71/70

[52] U.S. Cl. ..... 74/108; 335/76; 335/186

[58] Field of Search ..... 74/101, 102, 103, 104, 74/108, 50, 49; 200/330; 335/76, 68, 189

[56] References Cited

U.S. PATENT DOCUMENTS

| | | | |
|---|---|---|---|
| 2,180,561 | 11/1939 | Blood | 74/104 |
| 2,237,530 | 4/1941 | Olley | 74/50 |
| 3,171,920 | 3/1965 | Klein et al. | 200/92 |
| 3,213,235 | 10/1965 | Soos | 335/74 |
| 3,328,731 | 6/1967 | Huska | 335/74 |
| 3,551,921 | 6/1971 | Fox | 74/100 |
| 3,590,648 | 7/1971 | Gorman | 74/103 |

FOREIGN PATENT DOCUMENTS

| | | |
|---|---|---|
| 7018079 | 4/1970 | Fed. Rep. of Germany . |
| 1275093 | 10/1960 | France . |

*Primary Examiner*—William F. Pate, III
*Attorney, Agent, or Firm*—Kenyon & Kenyon

[57] ABSTRACT

Disclosed is a power drive for electric switchgear in which the driving force is elastically transmitted to an actuating member, for example, a handle. Thereby, tolerance compensation is provided to allow the drive motor to run into the end positions of the drive. A bending-type spring is disclosed as an elastic power transmitting member which is arranged transversely to the direction of motion of a slide which transmits the driving force to the switchgear. The bending-type spring can be connected to the slide. The bending-type spring can be a leaf spring, and more particularly two parallel leaf springs. In the disclosed embodiments, the two parallel leaf springs are provided as a single U-shaped leaf spring having parallel legs. The U-shaped leaf spring can either be supported at both ends thereof in the slide or the legs can be fastened in a mounting body connected to the slide.

16 Claims, 6 Drawing Figures

POWER DRIVE FOR ELECTRIC SWITCHGEAR IN WHICH DRIVING POWER IS ELASTICALLY TRANSMITTED THERETO

CROSS-REFERENCE TO RELATED APPLICATION

Some of the subject matter disclosed herein is common to subject matter disclosed in Application Ser. No. 253,585 filed Apr. 13, 1981 entitled POWER DRIVE INCLUDING A DRIVE SLIDE FOR ELECTRIC SWITCHGEAR Application Ser. No. 253,586 filed Apr. 13, 1981 entitled MOTOR DRIVE FOR LOW-VOLTAGE PROTECTIVE CIRCUIT BREAKER and Application Ser. No. 253,584 filed Apr. 13, 1981 entitled ROTARY HANDLE FOR MANUAL OPERATION OF AN EQUIPMENT POWER DRIVE. This application and the above-mentioned application are owned by the same assignee.

BACKGROUND OF THE INVENTION

The present invention relates to a power drive for electric switchgear in which driving power is elastically transmitted to an actuating member of the switchgear, particularly an actuating handle.

A power drive of the above-described type is disclosed, for example, in U.S. Pat. No. 3,171,920. The '920 patent discloses a power drive including coil springs which elastically resist movement of a frame by a motor, the frame being coupled to the actuating handle of the switchgear. Thereby, driving power is elastically transmitted to the actuating handle.

A slide for transmitting driving force to the actuating element of a switchgear is disclosed, for example, in U.S. Pat. No. 3,328,731, where the motor and the slide are rigidly connected by means of a crank drive.

OBJECTS AND SUMMARY OF THE INVENTION

It is an object of the present invention to provide for improved elastic power transmission from a motor to the actuating member of a switchgear.

It is another object of the present invention to provide for such elastic transmission simply and inexpensively.

It is also an object of the present invention to provide for such elastic transmission while avoiding an expensive guide means.

These and other objects of the present invention are achieved in accordance with the invention by providing spring means for the elastic transmission of the driving force to the actuating member, the spring means being arranged transversely to the direction of motion of a slide which transmits the driving power to the switchgear.

According to one aspect of the invention, the spring means provide a spring action by means of bending the spring. Such springs which are stressed purely flexurally, i.e., elongated springs of any desired cross-sectional shape, are more versatile in use than coil springs and therefore can substantially simplify the structure of a power drive.

In conjunction with arranging such a bending-type spring transversely to the direction of motion of the slide, in accordance with the invention, there is the advantage of a reduction in the space otherwise required for elastically transmitting power to the actuating member.

In accordance with another aspect of the invention, it is preferred to connect the bending-type spring to a slide which couples the driving force to the actuating member. Advantageously, the spring and slide can be provided as an easily installable assembly.

In accordance with still another aspect of the invention, the bending-type spring is a leaf spring. In a disclosed embodiment, two parallel leaf springs are advantageously provided and a reduction gear is interposed between the motor and the leaf springs. A crank pin of a crank arm, which constitutes a driven member of the power drive, is coupled to the reduction gear engages the leaf springs.

While two individual leaf springs can be provided in a parallel arrangement, it has been found to be advantageous according to an aspect of the invention to provide the two leaf springs as a single U-shaped leaf spring. A single U-shaped leaf spring not only reduces the number of parts but also provides the ability to obtain varying spring characteristics with the same spring. If, for example, the leaf spring is mounted so that the ends of the two legs of the U-shaped leaf spring are supported at support points in the slide, both legs can act as independent leaf springs which are supported at both ends.

According to still another aspect of the invention, the leaf spring can include at an end of one of the legs of the U-shaped leaf spring, an angled projection which can snap into a pocket-like recess of the slide to thereby provide for a snap-lock fastening of the leaf spring to the slide. A support element can be inserted between the legs of the U-shaped leaf spring to maintain the spring mounted to the slide, particularly when the spring is under heavy stress.

According to another aspect of the invention, the distance between the two parallel leaf springs can be reduced at least for part of the length of the springs to be less than the diameter of the pin of the crank arm. Resistance to motion of the crank pin can thereby be increased over the portion of the length of the leaf springs in which the distance between the springs is reduced, so that the motor driving the pin comes to an accelerated stop.

As mentioned above, the spring characteristic of the leaf spring can be influenced by the arrangement of two parallel leaf springs which are formed by the legs of one U-shaped leaf spring. As opposed to a leaf spring having independent parallel legs in which the action of the spring legs is independent, the legs of a U-shaped leaf spring can be brought to bear jointly, i.e., a steeper spring characteristic can be obtained. This can be accomplished, for example, by fastening the ends of the legs of the U-shaped leaf spring in a mounting body. According to an aspect of the invention, the mounting body can, for example, be a casting into which the ends of the legs are cast. The ends of the legs can also be held, however, in slots of the mounting body by a clamp or snap-fit. In such a clamp or snap-fit arrangement, the ends of the legs can be maintained in the slots against the action of forces occurring during operation of the power drive, by a rivet, a pin, a screw or the like, which goes through the mounting body and the leg ends.

A reliable clamp fit, however, can also be obtained in accordance with an aspect of the invention, by providing material which can be displaced or deformed by the spring ends. The material can be provided at the openings of the mounting body, on its side facing a transmission member, with the material being displaced when the leaf spring is inserted. The material can be provided as part of the mounting body, and advantageously as a constriction of the slot. When the leaf spring is inserted into the slots, the material accumulations are deformed or displaced, whereby firm clamping of the leaf spring is obtained independently of unavoidable tolerances.

These and other objects, aspects, features and advantages of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENT

Figure 1:
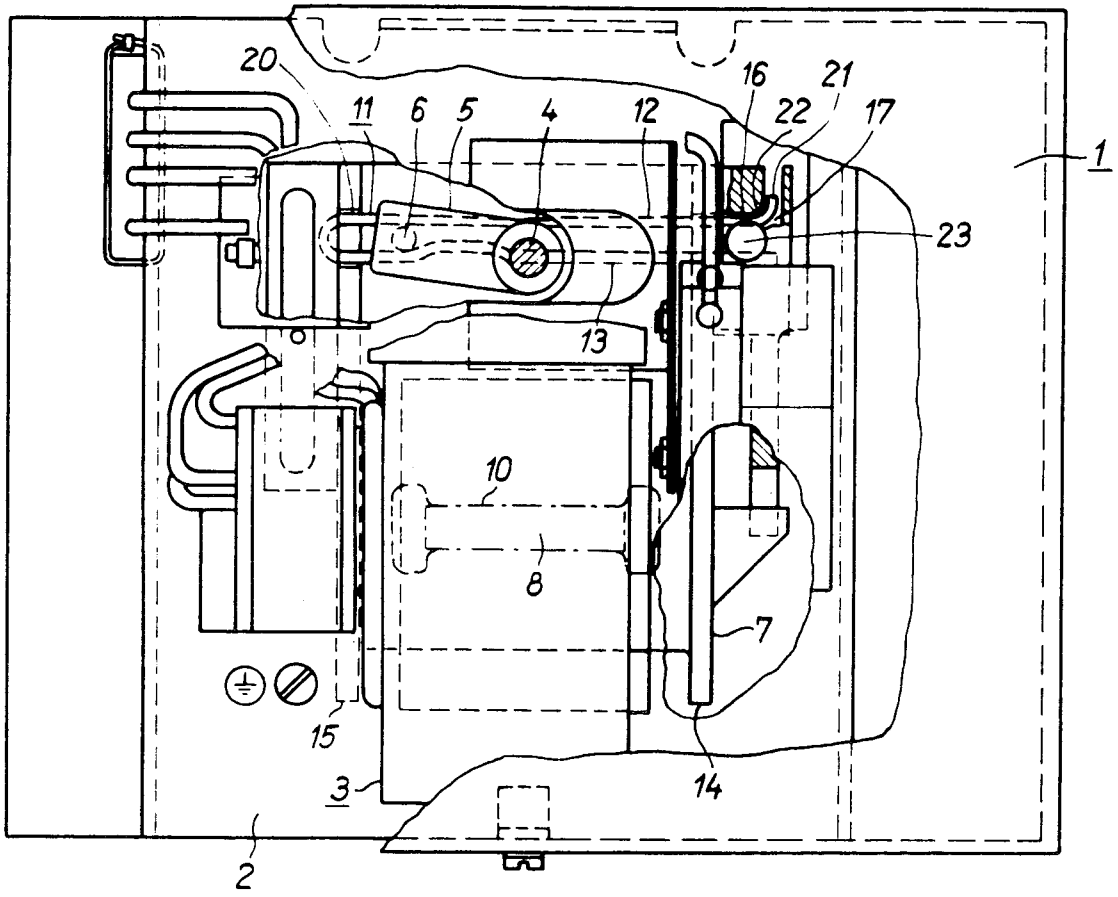
FIG. 1 is a top view partly broken away of a motor drive for a low-voltage protective breaker according to the invention, and illustrates a U-shaped leaf spring according to an embodiment of the invention.

Referring more particularly to the drawings, a motorized power drive 1 is shown in FIG. 1 and includes a support plate 2 on which a motor gear box 3 is mounted. A transmission shaft 4 which is perpendicular to the support plate 2 carries a crank arm 5 with a crank pin 6. A slide 7 is disposed under the support plate 2 and in the space between the support plate and the top or front side of a low-voltage protective breaker, not shown, for example, a breaker of the compact type. The slide 7 has a window-like opening 10 for an operating handle 8 of the protective breaker to pass through. In the slide 7 is fastened a U-shaped leaf spring 11 having legs 12 and 13 between which the crank pin 6 of the crank arm 5 is engaged.

The slide 7 has an approximately rectangular outline shape and has side walls 14 and 15 for guiding the slide on a projection on the top or front side of the protective breaker. The side wall 14 has an opening 16 which includes a pocket-like recess 17. The opposite side wall 15 further has a corresponding opening 20. Opening 20 is provided for the closed end of the U-shaped leaf spring 11 to pass through, while the free ends of the leaf spring legs extend through the opening 16. One leg has a rounded, bent end 21, for which a correspondingly rounded abutment 22 is provided in the pocket-like recess 17.

The leaf spring 11 is assembled into the power drive by the closed end thereof being first pushed through the opening 20; then the free leg ends are compressed together sufficiently so that they can be inserted through the opening 16 into the pocket-like recess 17. Upon release of the leg ends from compression, the bend end 21 pushes against the correspondingly bent abutment 22 and the leaf spring if firmly connected to the slide 7. Detachment of the leaf spring 11 from the slide 7 can be prevented under heavy stress by a fastener which may be formed, for example, by a screw 23 which extends between the legs of the leaf spring through a hole in the slide. The openings 16 and 20 of the slide 7 act as abutments to the legs 12 and 13 of the leaf spring 11, the bending line of each leg by itself corresponding to that of a beam supported at both ends.

Figure 2:
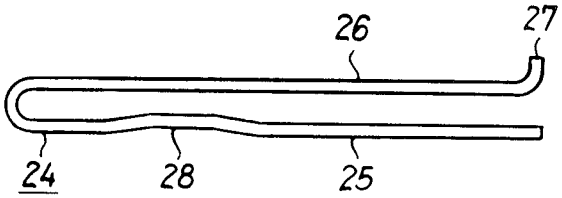
FIG. 2 is a top view of a leaf spring according to another embodiment of the invention.

The leaf spring 24 in FIG. 2 is shaped similarly to the leaf spring 11 in FIG. 1 and has corresponding legs 25 and 26 and a bent-off end 27 for locking or snap-fit fastening. In addition, the leg 25 of the leaf spring 24 is provided with a section 28 which is bent in the direction of the outer leg 26 and by which the distance between the legs is therefore reduced at section 28. When the crank pin 6 (FIG. 1) passes between the legs 25 and 26 at section 28, the legs are further bent, whereby a desired clamping action is exerted on the crank pin 6 and therefore on the motor, not shown, of the power drive.

Figure 3:
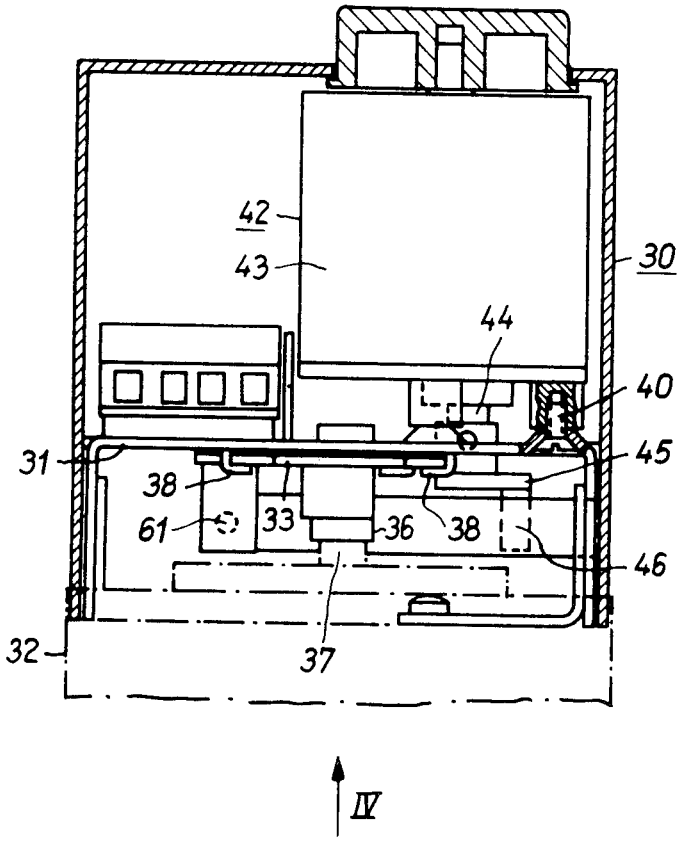
In FIG. 3 is a cross-sectional view of a motor drive according to the invention, and illustrating still another embodiment of a leaf spring and fastening means therefor.
Figure 4:
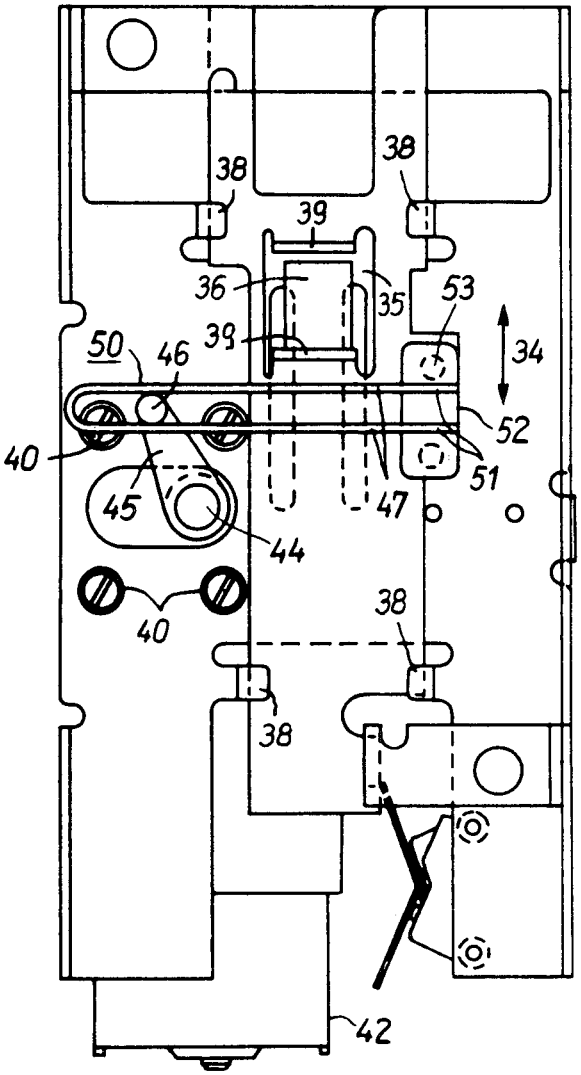
FIG. 4 is an elevation view of the motor drive of FIG. 3 from the direction of arrow IV of FIG. 3.

The power drive 30 according to FIGS. 3 and 4, which is provided for a low-voltage protective breaker 32, is a motorized drive as is that of FIG. 1. The motor drive 30 has a support plate 31 which is mounted to the protective breaker 32, shown by dashed-dotted lines, spaced from the front side thereof. A slide 33 made of sheet metal is movably guided on tabs 38 in the direction of the double arrow 34 on the side facing the front side of the protective breaker 32. The power drive 30 includes a window-like opening 35 having angled-off parts 39, with the slide 33 extending over a cylindrical body 36 placed on the end of an operating handle 37 of the protective breaker. The operating handle is connected to a toggle lever of the protective breaker 32 which is pivoted about a fulcrum for switching the protective breaker 32 on and off.

Figure 5:
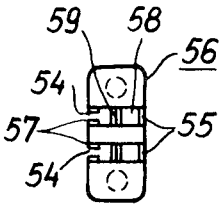
FIGS. 5 and 6 are top views of two embodiments of a mounting body for the embodiments of FIGS. 3 and 4.

A motor gear box 42 is fastened by means of screws 40 on support plate 31. The gear box includes gearing 43 which has a shaft 44 perpendicular to the support plate 31, and therefore perpendicular to the front side of the protective breaker 32. Connected to the shaft 44 is a crank arm 45 having a crank pin 46 engaged between the legs 47 of a U-shaped leaf spring 50. The leaf spring 50 can be seen most clearly in FIG. 4 which shows the motor drive in a view taken in the direction of the arrow IV in FIG. 3. The free ends 51 of the legs 47 of the leaf spring 50 are fastened in a mounting body 52 and the mounting body is in turn fastened by means of two screws, rivets or formed-on rivet shanks 53 to the slide 33. The mounting body 52 may, for example, be a casting into which the ends of the legs are cast. The mounting body can also be a metal block provided with slots, in which the leaf spring leg ends 51 are held by a clamping arrangement. Clamping can also be accomplished by providing a constriction at the opening 54 of slots 55 in a mounting body 56 as shown in FIG. 5. The constriction can be provided by material accumulations 57 in the opening 54. The accumulations are displaced or deformed when the leaf spring is inserted into the slots. The displacement or deformation of the material takes up unavoidable tolerances and provides a firm fit of the leaf spring. A similar material accumulation 59 can be provided on the connecting piece 58 of the mounting body 56 along the insertion direction of the leaf spring as compensation for height or length tolerances of spring.

Figure 6:
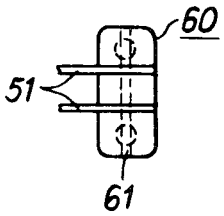

As a further means for obtaining a firm clamp fit of the U-shaped leaf spring, a rivet or screw 61 can be provided as shown in FIG. 6 for a mounting body 60. The rivet goes through the mounting body and the leg ends of the leaf spring. However, a tightening pin can also be used to secure mounting of the leaf spring while providing a certain amount of relative motion of the leg ends with respect to the walls of the slots of the mounting body.

The leaf spring is advantageously fastened in a mounting body so that the two legs bend together when a driving force is transmitted thereto from the crank pin to transmit force via the slide to the operating handle of the protective breaker. With the legs of the leaf spring bending together, the spring characteristics are added and the bending line of the leaf spring has an approximately S-shape.

The advantages of the present invention, as well as certain changes and modifications of the disclosed embodiments thereof, will be readily apparent to those skilled in the art. It is the applicants' intention to cover by their claims all those changes and modifications which could be made to the embodiments of the invention herein chosen for the purposes of the disclosure without departing from the spirit and scope of the invention.

What is claimed is:

1. In a power drive for electric switchgear having a driven member in which the driving force is elastically transmitted to an actuating member of the switchgear via a slide, the improvement comprising U-shaped leaf spring means having elongate substantially parallel legs coupled to the driven member and to the slide for elastically transmitting the driving force to the slide, said legs extending transversely to the direction of motion of the slide, said driven member being a crank arm having a crank pin engaging said spring means between the legs thereof.

2. The improvement according to claim 1, wherein the U-shaped leaf spring means is coupled to the slide at at least an end of the spring means corresponding to the free ends of said legs.

3. The improvement according to claim 1, wherein the slide includes support means and the ends of the two legs of the U-shaped leaf spring means are supported at the support means.

4. The improvement according to claim 3, wherein a free end of at least one of the legs is angled off and the slide includes a pocket-like recess into which the angled-off end can snap in a snap-locking manner.

5. The improvement according to claim 1 and comprising a supporting element inserted between the ends of the two legs of the U-shaped leaf spring means.

6. The improvement according to claim 1, wherein means are provided for reducing the distance between the two parallel legs of the U-shaped leaf spring means along at least a portion of the length thereof to be less than the diameter of the crank pin.

7. The improvement according to claim 1 and comprising a mounting body associated with the slide into which the ends of the legs of the U-shaped leaf spring means are fastened.

8. The improvement according to claim 7, wherein the mounting body is a casting having the ends of the legs cast therein.

9. The improvement according to claim 7, wherein the mounting body includes slots in which the ends of the legs are held by a clamp fit.

10. The improvement according to claim 9, wherein material is disposed at the openings of the slots of the mounting body on a side thereof facing the crank pin, the material being deformable under pressure.

11. The improvement according to claim 9, wherein material is deposed in the slots of the mounting body on a connecting piece of the mounting body along the direction of the leaf spring, the material being deformable under pressure.

12. The improvement according to claim 1, wherein the U-shaped leaf spring means is coupled to the slide at two transversely spaced locations with reference to the direction of motion of the slide.

13. The improvement according to claim 12, wherein the crank pin is coupled to the spring means between said two locations.

14. A power drive for an electric swtichgear which includes an actuating member, the power drive comprising a driven member coupled to a means for driving, a slide coupled to the actuating member, means for supporting the slide for motion in a direction to move the actuating member to activate the switchgear, and U-shaped leaf spring means having elongate substantially parallel legs extending transversely to the direction of motion of the slide and coupled to the driven member and the slide for elastically coupling the driving force of the driven member to the slide, said driven member being a crank arm having a crank pin engaging said spring means between said legs.

15. The power drive according to claim 14, wherein the U-shaped leaf spring means is coupled to the slide at two transversely spaced locations with reference to the direction of motion of the slide.

16. The power drive according to claim 15, wherein the crank pin is coupled to the spring means between said two locations.

* * * * *